US006568076B2

(12) United States Patent
Bottos et al.

(10) Patent No.: US 6,568,076 B2
(45) Date of Patent: May 27, 2003

(54) METHOD OF MAKING AN INTERNALLY PROFILED STATOR TUBE

(75) Inventors: Richard D. Bottos, Hockley, TX (US); Lance D. Underwood, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/874,709

(22) Filed: Jun. 5, 2001

(65) Prior Publication Data

US 2002/0041815 A1 Apr. 11, 2002

Related U.S. Application Data

(62) Division of application No. 09/092,544, filed on Jun. 5, 1998, now Pat. No. 6,309,195.

(51) Int. Cl.[7] ..... B23P 15/00

(52) U.S. Cl. ..... 29/888.023; 29/888.02; 72/276; 72/278; 72/283; 72/370.18

(58) Field of Search ..... 29/888.023, 888.02; 72/46, 67, 68, 81, 80, 96, 105, 276, 278, 283, 370.01, 370.18; 418/48, 178, 153; 175/107

(56) References Cited

U.S. PATENT DOCUMENTS

| | | | | | |
|---|---|---|---|---|---|
| 629,245 | A | * | 7/1899 | Frank | 72/112 |
| 1,605,828 | A | * | 11/1926 | Frahm | 72/178 |
| 3,354,537 | A | * | 11/1967 | O'Connor | 29/402.09 |
| 3,783,663 | A | * | 1/1974 | Prajsnar et al. | 72/283 |
| 3,798,943 | A | * | 3/1974 | Benteler et al. | 72/283 |
| 3,841,136 | A | * | 10/1974 | Withers et al. | 29/890.049 |
| 3,982,858 | A | * | 9/1976 | Tschirky | 175/107 |
| 4,221,036 | A | * | 9/1980 | McCoy et al. | 29/432 |
| 4,336,702 | A | * | 6/1982 | Amado, Jr. | 72/75 |
| 4,415,316 | A | * | 11/1983 | Jurgens | 175/107 |
| 4,454,745 | A | * | 6/1984 | Cudini | 72/283 |
| 4,622,840 | A | * | 11/1986 | Diffenderfer et al. | 72/276 |
| 4,748,835 | A | * | 6/1988 | Sansome et al. | 72/283 |
| 4,805,435 | A | * | 2/1989 | Sukimoto et al. | 72/283 |
| 4,909,337 | A | * | 3/1990 | Kochnev et al. | 175/107 |
| 4,991,292 | A | * | 2/1991 | Bostel | 29/888.02 |
| 5,145,342 | A | * | 9/1992 | Gruber | 418/153 |
| 5,145,343 | A | * | 9/1992 | Belcher | 418/153 |
| 5,171,138 | A | * | 12/1992 | Forrest | 418/153 |
| 5,221,197 | A | * | 6/1993 | Kochnev et al. | 29/888.023 |
| 5,983,695 | A | * | 11/1999 | Lutz | 72/370.19 |
| 6,158,988 | A | * | 12/2000 | Jager | 29/888.023 |
| 6,241,494 | B1 | * | 6/2001 | Pafitis et al. | 175/107 |
| 2002/0043089 | A1 | * | 4/2002 | Reiche et al. | 72/283 |

* cited by examiner

*Primary Examiner*—Irene Cuda-Rosenbaum
(74) *Attorney, Agent, or Firm*—Conley Rose, P.C.

(57) ABSTRACT

A method of manufacturing a thick walled Moineau-style stator entails drawing a thick walled tube through rotatable internal and external dies to form a helical outer profile including crests and through on the tube. The tube initially has one end with a diameter smaller than the others, with the smaller diameter end being inserted between the inner and outer dies, where it is seized and drawn through the dies.

4 Claims, 8 Drawing Sheets

METHOD OF MAKING AN INTERNALLY PROFILED STATOR TUBE

CROSS-REFERENCE TO RELATED APPLICATIONS

This is a divisional application of pending U.S. patent application Ser. No. 09/092,544, filed Jun. 5, 1998 now U.S. Pat. No. 6,309,195.

STATEMENT REGARDING FEDERALLY SPONSORED RESEARCH OR DEVELOPMENT

Not Applicable.

BACKGROUND OF THE INVENTION

1. Field of the Invention

The present invention relates generally to a novel drilling motor component. More particularly, the present invention relates to an improved stator and related methods of manufacture for a Moineau style motor.

2. Description of the Related Art

Referring to FIG. 1, in drilling a borehole 100 in the earth, such as for the recovery of oil, it is conventional practice to connect a drill bit 110 on the lower end of an assembly of drill pipe sections that are connected end-to-end so as to form a "drill string" 120. The drill string 120 is rotated and advanced downward, causing the drill bit to cut through the underground rock formation. A pump 130 on the surface 140 typically takes drilling fluid (also known as drilling mud), represented by arrows 135, from a mud pit 132 and forces it down through a passage in the center of the drill string 120. The drilling fluid then exits the drill bit 110, in the process cooling the face drill bit. The drilling mud returns to the surface 150 by an area located between the borehole and the drill string, carrying with it shavings and bits of rock from downhole.

A conventional motor (not shown) is typically located on the surface to rotate the drill string 120 and thus the drill bit. Often, a drill motor 160 that rotates the drill bit may also be placed as part of the drill string a short distance above the drill bit. This allows directional drilling downhole, and can simplify deep drilling. One such motor is called a "Moineau motor" and uses the pressure exerted on the drilling fluid 135 by the surface pump 140 as a source of energy to rotate the drill bit 110.

FIG. 2 is a cut-away top view of a prior art Moineau motor. Motor housing 210 contains an elastomeric rubber stator 220 with multiple helical lobes. The stator of FIG. 2 has 7 lobes, although a stator for a Moineau motor with as few as two lobes is possible. Three of these lobes are labeled 225. A typical stator lobe makes a complete spiral in 36 inches. This distance is known as the pitch length. Inside the stator 220 is a rotor 240, the rotor 240 by definition having one lobe fewer than does the stator. The rotor has an identical pitch length to that of the stator. The rotor 240 and stator 220 interengage at the helical lobes to form a plurality of sealing surfaces 260. Sealed chambers 250 between the rotor and stator are also formed. The rubber of the stator degenerates at areas 231–237 and at areas 271–277.

In operation, drilling fluid is pumped in the chambers 250 formed between the rotor and the stator, and causes the rotor to nutate or precess within the stator as a planetary gear would nutate within an internal ring gear. The centerline of the rotor travels in a circular path around the centerline of the stator. The gearing action of the stator lobes causes the rotor to rotate as it nutates. The nutation frequency is defined as the multiple of the number of rotor lobers times the rotor revolution speed. In the case of a six-lobed rotor, the centerline of the rotor travels in a complete circle six times for each full rotor rotation.

One drawback in such prior art motors is the stress and heat generated by the movement of the rotor within the stator. There are several mechanisms by which heat is generated. The first is the compression of the stator rubber by the rotor, known as interference. Interference is necessary to seal the chambers to prevent leakage and under typical conditions may be on the order of 0.005" to 0.030". The sliding or rubbing movement of the rotor combined with the forces of interference generates friction. In addition, with each cycle of compression and release of the rubber, heat is generated due to internal viscous friction among the rubber molecules. This phenomenon is known as hysteresis. Cyclic deformation of the rubber occurs due to three effects: interference, centrifugal force, and reactive forces from torque generation. The centrifugal force results from the mass of the rotor moving in the nutational path previously described. Reactive forces from torque generation are similar to those found in gears that are transmitting torque. In addition, heat may also be present from the high temperatures downhole.

Because elastomers are poor conductors of heat, the heat from these various sources builds up in the thick sections 231–237 of the stator lobes. In these areas the temperature rises higher than the temperature of the circulating fluid or the formation. This increased temperature causes rapid degradation of the elastomer. Also, the elevated temperature changes the mechanical properties of the rubber, weakening the stator lobe as a structural member and leading to cracking and tearing of sections 231–237, as well as portions 271–277 of the rubber at the lobe crests.

These forms of rubber degeneration are major drawbacks because when a downhole motor fails, not only must the motor be replaced, but the entire drillstring must be "tripped" or drawn from the borehole, section by section, and then re-inserted with a new motor. Because the operator of a drilling operation is often paying daily rental fees for his equipment, this lost time can be very expensive, especially after the substantial cost of an additional motor.

One known approach to increase the durability of a Moineau motor is to reduce the interference of the motor so that less heat is generated. However, this will reduce the torque available to rotate the downhole drill bit and so may not be an acceptable alternative. Another solution to the durability problem may be to lengthen the motor so that less heat is generated per foot of motor length. However, this approach imposes additional cost and weight to the motor. Further, depending upon the application downhole, a longer motor may not be desirable.

Other configurations for Moineau motors have also been suggested, such as U.S. Pat. No. 4,676,725 to Eppink and U.S. Pat. No. 5,171,138 to Forrest. However, many of these configurations are undesirably complex from a manufacturing perspective, and thus can be very expensive to make. In addition, some of these concepts limit the cross-sectional area or do not provide good paths for heat conduction.

Other problems have also existed in the prior art motors, and thus a downhole motor is needed that solves or minimizes many of these problems. Ideally, such an improved motor would provide improved structural integrity and heat conduction, thereby leading to increased durability and reduced failure from degeneration of the elastomeric portions of the rotor and stator downhole. Alternately, such an improved motor could be shorter or have greater power than a prior art motor, while maintaining good durability. Further, such a motor should solve other problems present in the prior art and should be manufacturable at a low cost so that it can attain widespread use by the industry.

SUMMARY OF THE INVENTION

The present invention features a thick wall stator that includes an inner profile and an outer profile. The inner profile of this stator has multiple helical lobes and the outer profile of this stator generally conforms to, or tracks, the shape of the inner profile.

The present invention also features a first method to manufacture such a stator. This method includes providing a first die and a second die, each of these dies having the helically lobed shape of the stator.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
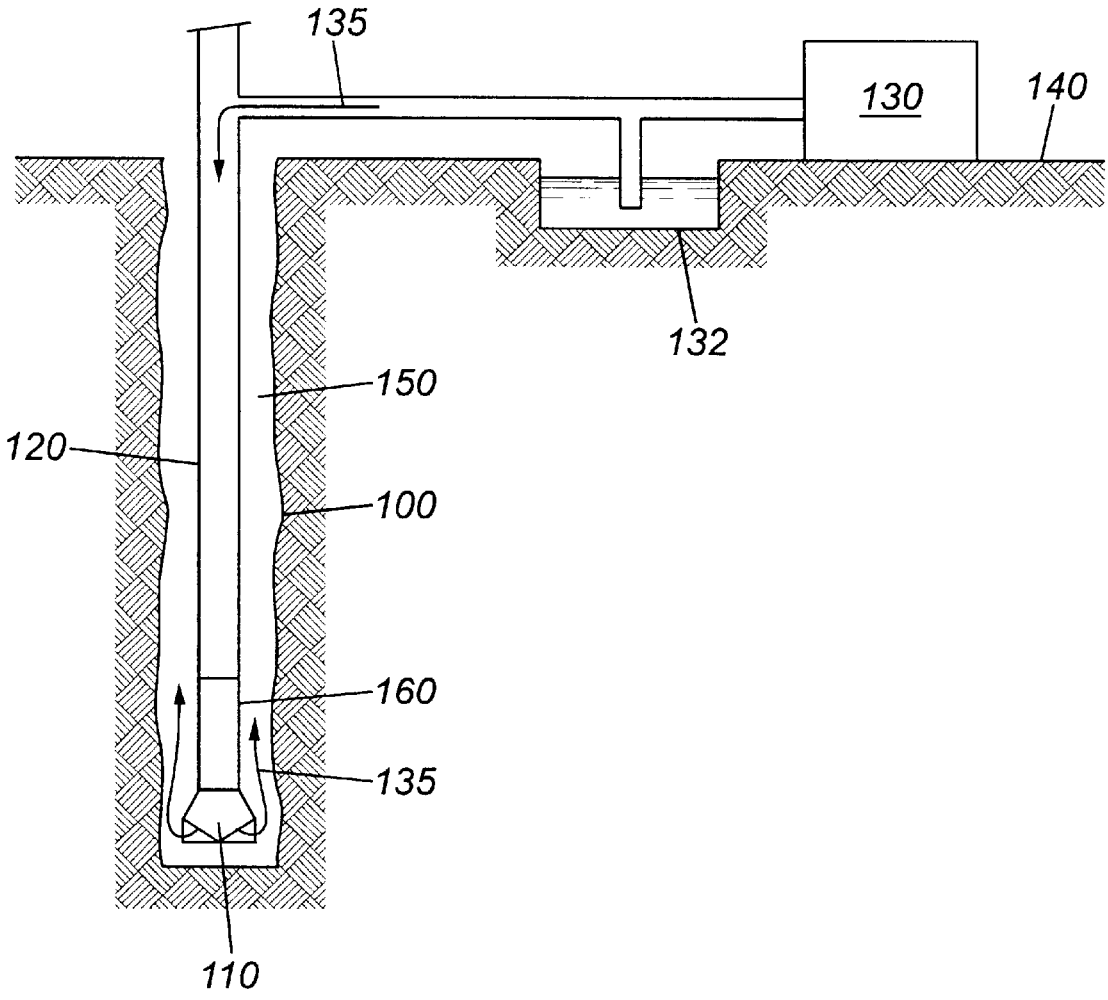
FIG. 1 is a prior art drilling system.
Figure 2:
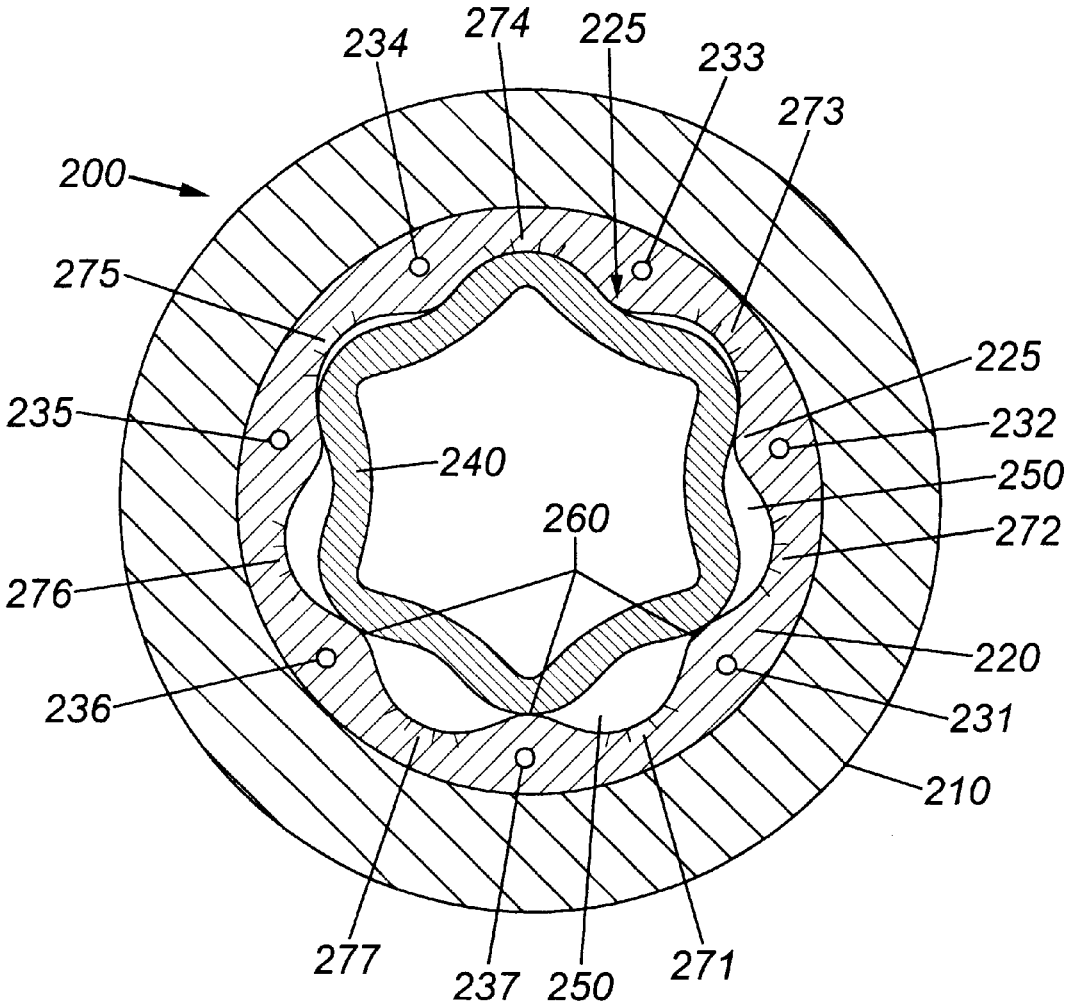
FIG. 2 is a cut away end view of a Moineau-style motor including a stator with points of rubber degeneration.
Figure 3:
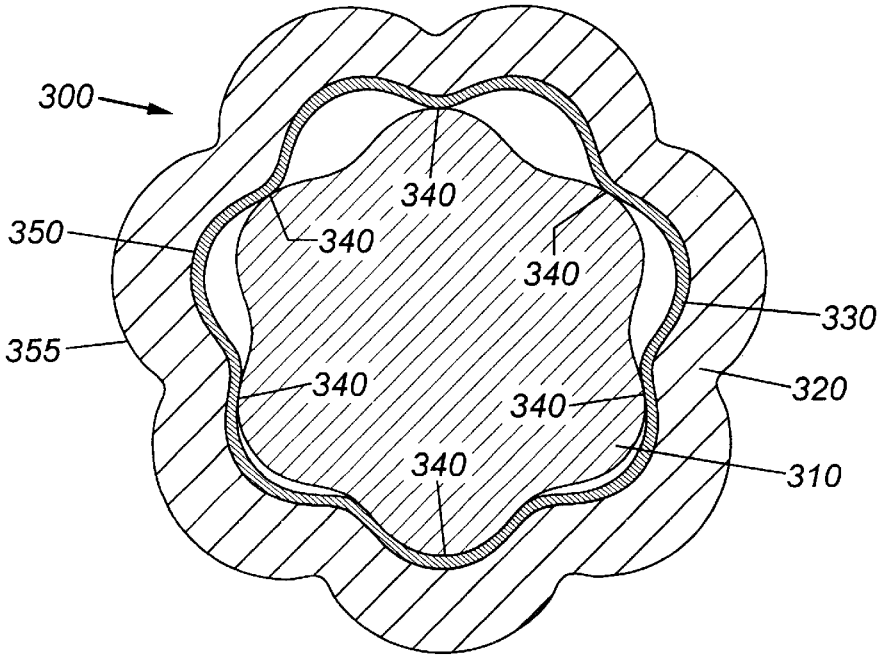
FIG. 3 is a cut away end view of a stator built in accord with a preferred embodiment of the present invention.
Figure 4:
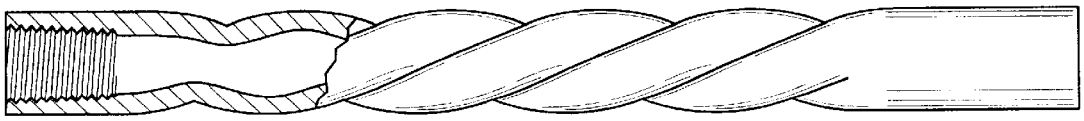
FIG. 4 is a side view of a stator built in accord with a preferred embodiment of the present invention.

FIG. 3 is a cut-away top-view of a Moineau style motor 300 manufactured in accordance with a preferred embodiment of the invention. A rotor 310 is configured as known in the prior art and has multiple helical lobes. Rotor 310 may be solid or hollow. Rotor 310 resides in a thick-walled stator 320, which has an inner profile 350 and an outer profile 355. Molded or attached to stator 320 is an elastomeric layer 330. Alternately, the elastomeric layer may be placed on the rotor, but the construction of the metal stator 320 will be unaffected. The rotor and elastomeric layer 330 interengage at the helical lobes to form sealing surfaces 340. The inner profile 350 of stator 320 follows the curvature of elastomeric layer 330 and thus the thickness of elastomeric layer 330 is constant. The outer profile 355 of stator 320 generally tracks or conforms to the helical geometry of the inner profile of stator 320. The grooves along the outer profile 355 of stator 320 that correspond to the inner helical lobes must also twist along the length of the preferred embodiment, as shown in FIG. 4.

Referring back to FIG. 3, the constant thickness of elastomeric layer 330 eliminates a substantial amount of rubber as compared to many prior art Moineau motors. In addition, less heat is generated because heat generation (hysteresis) in rubber is a function of strain, and under a constant load, a thinner rubber results in lower heat generation. A thinner rubber also results in less swelling of the rubber in aggressive drilling fluids and at elevated temperatures, which also helps reduce interference and its consequent heat generation. Additionally, cracking of the rubber at the crests of the stator lobes due to pressure bending of a thick elastomer profile is minimized, further reducing repetitive stress induced fatigue.

As can be seen, the preferred embodiment's stator 320 is always proximate to the sealing surface. The proximity of stator 320 to the sealing surface reinforces the rubber, which reduces tearing when high loads are applied. In addition, because steel is a much better heat conductor than is rubber, the proximity of stator 320 to the sealing surface also permits the stator to dissipate a substantial amount of heat that otherwise could cause degeneration and failure of the rubber that comprises the sealing material.

Because the stator is thick walled, it is not necessary for additional drill piping or other support to be provided adjacent the stator. As used herein "thick walled" refers to thicknesses of at least about ⅜". More preferably, the walls are on the order of ½". The thick wall of the preferred embodiment allows the stator to withstand directly the weight and rotation forces present downhole. The thick wall of the preferred stator also eliminates the cost of additional piping, and further eliminates any difficulties present when placing a stator inside drill pipe or drill string housing. Further, the improved strength of thick wall steel when contrasted to a thin wall counterpart allows a higher operating pressure drop for a given stator length, resulting in a higher power output. Moreover, the undulating outer profile 355 of the stator 320 presents minimum contact area to the hole wall, reducing the chances of differential sticking.

The preferred embodiment's thick wall is a significant advance. However, as the thickness of the stator piping increases, manufacturing becomes significantly more complex. Thus new methods of manufacture are also required to manufacture such a configuration simply and economically. Further, although a distinctive shape is provided by the stator disclosed herein, nonetheless the ends of such a stator connect with the drill string and drill bit. As such, during manufacture, the ends of the stator 320 should be a geometry that facilitates connection, such as a cylindrical shape as shown in FIG. 4.

Figure 5:
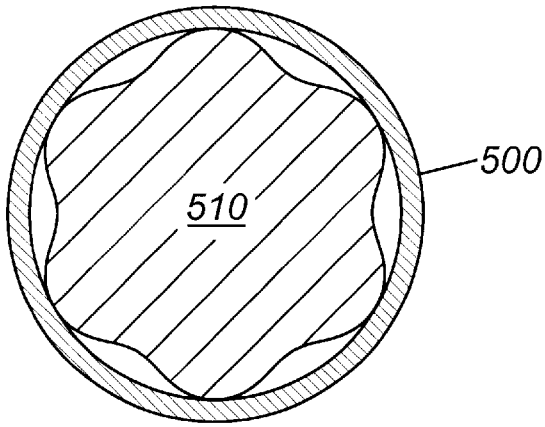
FIG. 5 is an internal die and an unworked tube prior to the tube's formation into a stator.

Stator 320 may be manufactured by any one of three manufacturing methods disclosed herein. A first method to manufacture the stator is the rolling method. This method may be practiced at either low or high temperature. Referring now to FIG. 5, a cylinder or tube 500 suitable for machining contains a metal core or internal die 510 preferably along its entire length. This metal core 510 also includes helical lobes along its length. These lobes support the metal cylinder 500 upon its manufacture into its ultimate distinctive shape. The internal core or die should be lubricated to facilitate its removal and reuse after the formation of the lobed inner surface.

Figure 6:
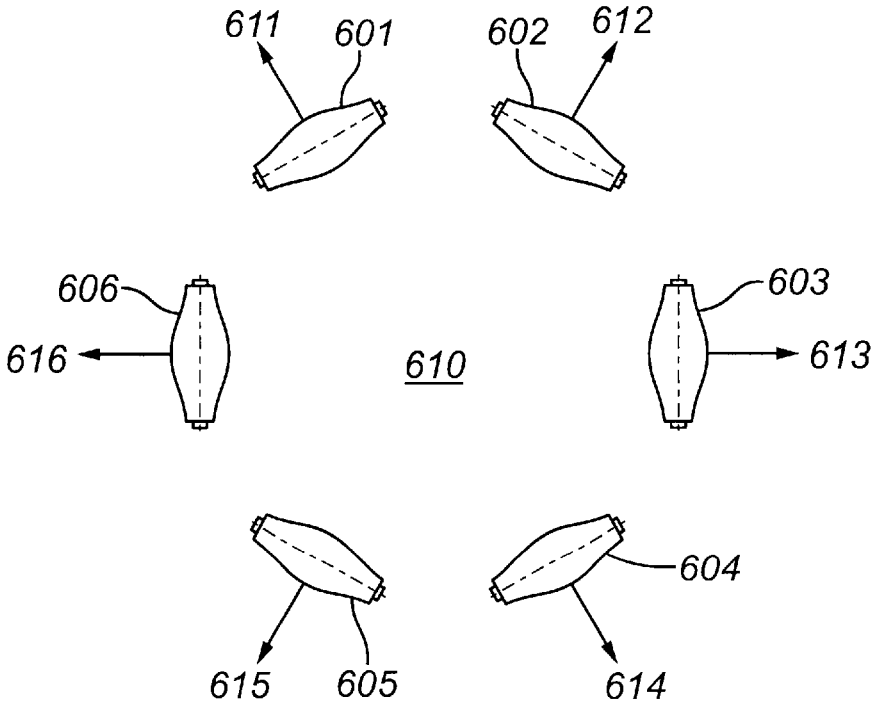
FIG. 6 is a set of rollers used for a first method of manufacture for the preferred stator.
Figure 7A:
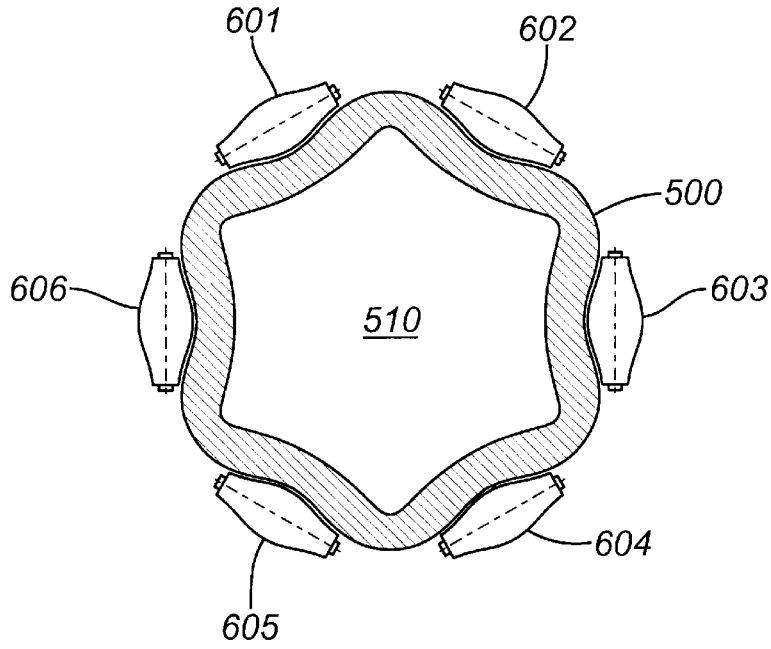
FIG. 7 is the set of rollers of FIG. 6 while forming the preferred stator.

Referring now to FIG. 6, a set of rollers 601–606 are shown. Also shown is open area 610. Rollers 601–606 are shown in a compressed configuration, although they also can move outward in a radial direction, as indicated by arrows 611–616, to achieve an uncompressed configuration. One end of a metal cylinder 500 including internal die 510 is provided to open area 610 while rollers 601–606 are in an uncompressed configuration. Rollers 601–606 then begin to compress or draw together. Upon contact between the rollers and the tube, the metal cylinder or tube 500 may be drawn or pushed through the set of rollers 601–606. Preferably, however, the rollers 601–606 are themselves powered to propel the tube through the set of rollers 601–606. The force exerted by the compression of rollers 601–606 forms grooves in the exterior of the metal cylinder, as shown in FIG. 7. These grooves, in combination with the inner die 510, form the lobes along the inner diameter of stator 320.

Figure 7B:
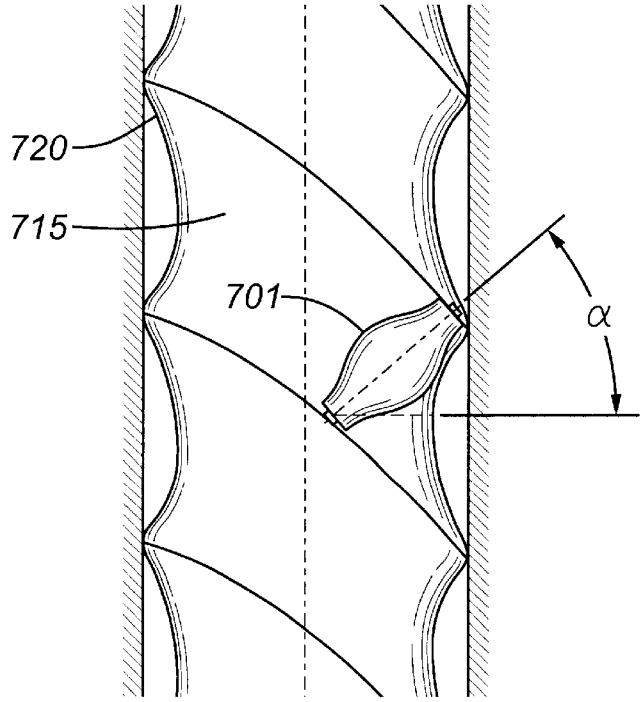

The twisting profile of the grooves on the exterior of stator 320 present certain problems. Because the rollers form the grooves that result in the inner profile for the stator 320, and because the grooves travel around a line passing through the center of the stator 320, rollers 601–606 must be placed at a slight axial angle to twist correctly the metal cylinder 500. Referring now to FIG. 7B, an illustrative roller 71 makes a groove 710 on the tube 720. A longitudinal axis 730 extends through tube 720. Roller 701 is placed at an angle $\alpha$ to a line perpendicular to the longitudinal axis. The rollers 601–606 should be rotatable so that the angle $\alpha$ can change, but should also be restricted or locked to one particular $\alpha$ during manufacture of a tube.

The powering of the inclined axis rollers propels and rotates the tube so that the grooves travel in a helical or twisting manner along the length of the metal cylinder 500. Multiple passes through the set of rollers will be required where a single trip through the rollers is not sufficient to create grooves of a desired depth. The independent powering of the rollers 601–606 facilitates multiple passes in a bi-directional manner through the set of rollers 601–606. Thread-rolling equipment can hold the very tight tolerances that are required, and will be much cheaper than internal machining of helical lobes.

Referring back to FIG. 7A, although a set of six rollers is shown in FIG. 7A to create a 6 lobed stator, this is not necessary. While a one-to-one correspondence between the number of rollers and the number of grooves (and hence lobes) may be ideal to minimize manufacturing error in the stator profile, it is also more expensive than absolutely necessary. The use of a minimum of two rollers is expected to result in an adequate stator profile. Further, the rollers need not be of the exact shape shown. Rollers adequate for the rolling method must merely have a rolling surface that creates satisfactory grooves in the tube surface corresponding to the inner profile lobes.

After manufacture by the rolling method, the internal die 510 must be withdrawn from the thick wall housing, the pitch stages should be aligned as described below, and a layer of rubber should be applied to the inner profile of the now-formed stator 320. Internal die 510 should be lubricated to simplify the removal process.

Figure 8A:
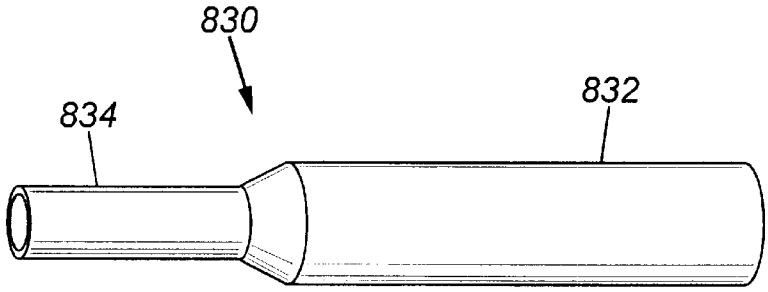
FIG. 8 is a side view of an apparatus according to a second method of manufacture to form the preferred stator.

A second method of manufacture is the drawing method. This cold temperature (i.e. room temperature) method preferably will be used to manufacture the stator disclosed herein. For this method of manufacture, a swaged metal tube is pulled through a pair of rotatable dies and the ends are re-forged to attain the desired cylindrical shape. Referring now to FIG. 8A, a swaged steel tube 830 includes a full diameter portion 832 and a reduced diameter portion 834 at one end. Portion 834 of steel tube 830 is swaged to reduce its diameter and to simplify its insertion into the drawing machine shown in FIG. 8B. Instead of swaging, any method may be used to attain generally the shape shown in FIG. 8A to assist in placement of tube 830 in the machine of FIG. 8B.

Figure 8B:
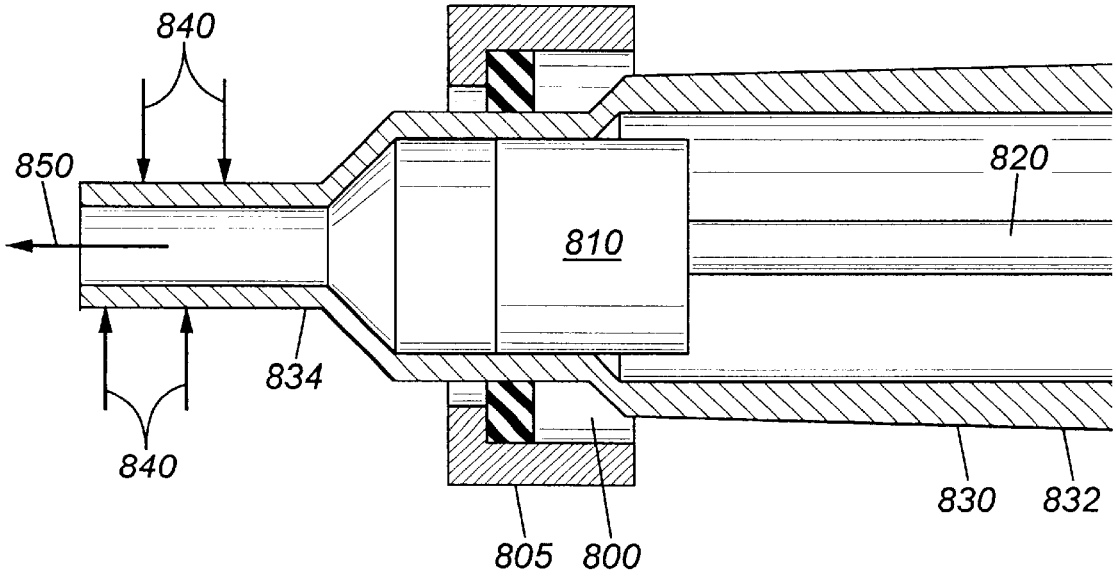
Figure 9:
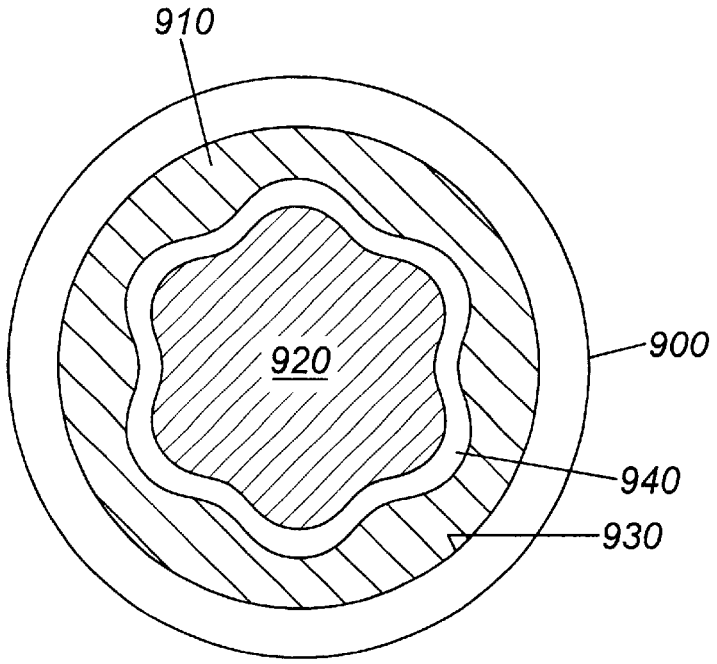
FIG. 9 is a cut away end view of dies used to form the preferred stator according to a second method of manufacture.

Referring now to FIG. 8B, a machine suitable for the drawing method includes an external rotatable die 800 supported by a housing 805; Rotatable internal die 810 has a smaller diameter than external die 800 and is supported by mandrel 820, which extends inside die 810 during formation of tube 830. FIG. 9 shows the relationship of the internal and external dies for the cold drawing process. A stationary die fixture 900 contains a rotatable external die 910 and a rotatable internal die 920. External die fixture 900 and external die 910 interface at a thrust bearing 930. Also present is tube or pipe 940.

Referring back to FIG. 8, steel tube 830 is seized and pulled portion 834 by a mechanical device as indicated by arrows 840. This results in tube 830 being drawn between the dies in direction 850. Inner die 920 and external die 910 rotate while tube 830 is being pulled through, with the twist of the dies forming the twist in the tube shape that is necessary for a stator. Both the inner and outer dies 920 and 910 should be lubricated to simplify this drawing process. A thick-walled tube with grooves on its outer profile and lobes on its inner profile results.

Further, the drawing of the metal cylinder 830 stretches and lengthens it, which results in a straightening of the grooves on the outer and inner profiles of the metal cylinder. If the dies are rotatable at adjustable speeds, this effect can be accounted for by simply increasing the rotation speed of the inner and outer dies, and thereby putting more twist in the tube 500 as it is pulled through the drawing machine. Alternately, a predetermined increase in rotation speed may be used. A tight tolerance of $^{10}/_{1000}$ths of an inch per pitch stage is required between the stator lobes and the rotor lobes, with each pitch stage being one revolution or twist (normally around 36 inches).

Figure 10:
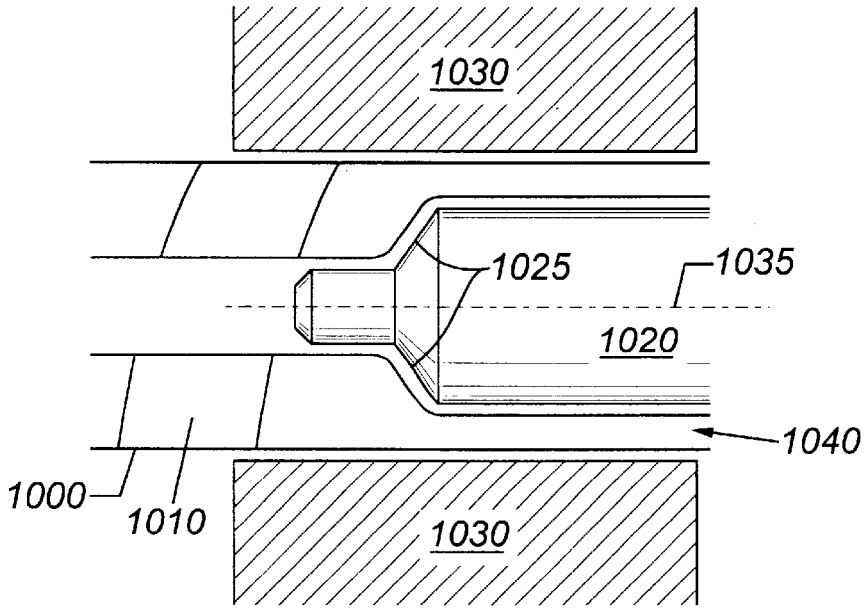
FIG. 10 is a side view of an apparatus that forms the cylindrical ends of the preferred stator according to the second method of manufacture.

After the tube 830 has been pulled through the inner and external dies, it should be reworked so that it has cylindrical ends. Referring now to FIG. 10, an internal reforming die 1020 including angled portions 1025 is forced inside a stationary metal cylinder 1000 along centerline 1035. Outer dies 1030 support a cylinder 1000, which has been manufactured to include grooves 1010, while die 1020 is forced inside the metal cylinder 1000. Die 1020 re-forms one end 1040 of the cylinder 1000 from a grooved outer profile to a cylindrical outer profile better adapted to connection to other drill string sections. Angled portions 1025 are designed to prevent tearing of the inner tube shape and thus must not be at too severe of an angle. This re-forming process preferably is done to both ends of cylinder 1000 and shapes it into stator 320. A layer of rubber is then preferably applied to the inner profile of the stator 320.

Figure 11:
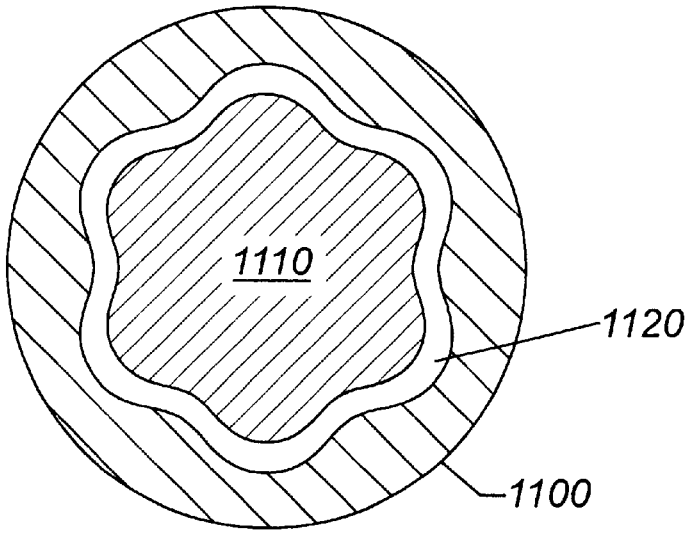
FIG. 11 is an end view of a pair of dies according to a third method of manufacture.

Stator 320 may also be manufactured by a third method, an extrusion process, at about 2250 degrees Fahrenheit. In this method, a hot metal cylinder is forced through a pair of dies as shown in FIG. 11. Outer die 1100 and inner die 1110 define an open area 1120. Each of these dies has a helical lobed shape. Soft metal is then forced through these dies. Because the metal of the tube is relatively soft at elevated temperatures, grooves corresponding to helical lobes are formed in the tube. The twist of the dies, combined with the forcing of the tubes through the dies, rotates the cylinder and thus the dies can remain stationary while helical grooves are formed in the metal tube. The tube thereby acquires the lobed shape of the stator 320. The ends of the tube can then be re-formed, a process that is simplified because of the elevated temperature and the concomitant softness of the tube.

Regardless of which method is chosen to manufacture the lobed tube, the twist in the tube should be precise. Therefore, an additional step that is preferred in each method is to adjust the tube pitch. To accomplish this, a known point on the tube profile is chosen, such as the apex of one lobe. This point can be lined up with a corresponding point or points exactly one or more stages or twists down the tube. A laser is preferably used as the most precise way to measure and compare these two or more points to ensure that they align, but other techniques such as inscribing lines at the points may also be used. If there is unwanted misalignment between two or more points, the tube should be mechanically seized and twisted to align the points of interest. After the tube has been aligned properly, the tube is then heat treated to regain its strength in accordance with known techniques.

Figure 12:
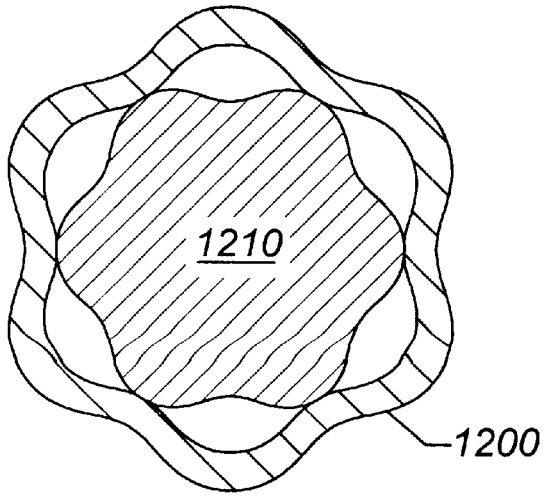
FIG. 12 is a stator and core engaged to show an extreme rotation in one direction.

A layer of elastomeric or rubber is then preferably applied to the inner profile of the stator. This is done after heat treatment of the stator has been completed. Referring now to FIG. 12, to accomplish application of the elastomeric layer, a core 1210 is inserted into the stator body 1200 and then aligned. The outer profile of the core 1210 should be carefully manufactured to exact dimensions and should track the inner profile of the stator 1200. To align the core 1210 to the stator1200, two extreme rotation positions should be established, preferably by determining the points at which the lobes of the core 1210 contact the lobes of the stator 1200. One such extreme rotation position is shown in FIG. 12. The mid-point rotation position between these two points is the theoretical position at which there is a constant spacing between the outer profile of the core and the inner profile of the stator. The core should then be rotated to this mid-point. After this mid-point position has been achieved, the core and stator should be locked into position relative to one another. Rubber may then be injected between the stator and core. Because the spacing between the stator and core is constant, the rubber will have a constant thickness. After curing the rubber, the core should be removed and may be reused.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. For example, the preferred tubing shape made by the disclosed methods of manufacture need not be used only for a stator, but can be used for any appropriate purpose. Accordingly, the scope of protection is not limited to the embodiments described herein, but is only limited by the claims that follow, the scope of which shall include all equivalents of the subject matter of the claims.

What is claimed is:

1. A method of manufacturing a thick walled stator by drawing, comprising:

(a) providing a thick wall tube, said tube having a first diameter at a first end and a second diameter at a second end, wherein said second diameter is less than said first diameter;

(b) providing a rotatable external die and a rotatable internal die, said rotatable external die and said rotatable inner die defining an area of insertion for said second end of said thick wall tube;

(c) inserting said second end of said thick wall tube to said area of insertion;

(d) seizing said thick wall tube;

(e) drawing said thick wall tube through said rotatable internal die and said rotatable external die to form a helical outer profile including crests and troughs.

2. The method of claim 1, further comprising:

(f) working said thick wall tube so that said first and second ends are radial.

3. The method of claim 2, said method including the step of aligning said crests and troughs.

4. The method of claim 2, further comprising:

(f) applying a layer of rubber to an inner profile of said thick wall tube.

* * * * *